US005584479A

United States Patent [19]

Smith

[11] Patent Number: 5,584,479

[45] Date of Patent: Dec. 17, 1996

[54] BASKETBALL NET DEVICE

[75] Inventor: Jason P. Smith, Mississauga, Canada

[73] Assignee: Jason P. Smith & Partners, Mississauga, Canada

[21] Appl. No.: 263,774

[22] Filed: Jun. 22, 1994

[51] Int. Cl.[6] ..... A63B 63/08

[52] U.S. Cl. ..... 273/1.5 R

[58] Field of Search ..... 273/1.5 R, 1.5 A, 273/400, DIG. 30; 232/43.1, 1 B

[56] References Cited

U.S. PATENT DOCUMENTS

| | | |
|---|---|---|
| 3,814,359 | 6/1974 | Powell . |
| 4,805,903 | 2/1989 | McArdle . |
| 4,834,368 | 5/1989 | Qualley . |
| 4,903,964 | 2/1990 | Anderson . |
| 4,905,995 | 3/1990 | Apo . |
| 5,098,091 | 3/1992 | McGiven . |
| 5,123,642 | 6/1992 | Stokes . |
| 5,156,394 | 10/1992 | Deal . |
| 5,405,132 | 4/1995 | St. Onge ..... 273/1.5 R |

*Primary Examiner*—Paul E. Shapiro
*Attorney, Agent, or Firm*—Cummings & Lockwood

[57] ABSTRACT

A basketball net device for mounting on a raised basketball hoop including a generally tubular netting having upper net cords. A flexible annular member made of plastics material includes a hoop engaging portion which is generally channel-shaped in cross-section for a substantial portion of the circumference of the annular member. There are holes for connecting the upper net cords to the annular member. A circumferential section has an outer portion of the hoop engaging portion cut-away, leaving only a narrow inner portion thereof that engages the inner half of an upper surface of the hoop. The device can be readily removed from the hoop by pulling down on it and thereby pulling it through the hoop. Preferably the netting has closure devices, such as Velcro tape strips, for temporary closing off the opening at the bottom end of the netting. These devices are used to prevent a basketball from passing completely through the netting and for mounting the device on the hoop.

12 Claims, 4 Drawing Sheets

BASKETBALL NET DEVICE

BACKGROUND OF THE INVENTION

This invention relates to devices for mounting netting on a basketball hoop.

In the well known sport of basketball, a ball receiving hoop is mounted at each end of the court and this hoop supports a generally tubular netting through which a basketball can pass. Each hoop is rigidly mounted by means of one or more support arms and is located in front of a backboard. The hoop or metal ring has an inside diameter of eighteen inches and it is located ten feet off the ground normally.

Because of the height of these hoops, it can be difficult under some circumstances to instal a new or replacement net on the hoop. Often a suitable ladder is required or a platform to stand on.

There are many outdoor basketball courts and outdoor areas where basketball can be played. Although many of these courts have suitable basketball hoops installed at the ends of the courts, often these hoops do not have any nets attached. The lack of a net may be due to several possible reasons including the height of the hoops from the court or playing surface, which height makes it difficult for maintenance personal to replace the nets. Also, the heavy use of public courts may make the life expectancy of the nets quite short and it may be too expensive for the owner to replace the nets frequently. The nets may also be stolen in such areas or simply destroyed because of improper use. Despite these problems with nets or the lack thereof, most basketball players prefer to play basketball with goal hoops at each end which have nets. When a net is mounted on each hoop, there can be little dispute as to whether the ball has or has not passed through the hoop when the shot is made. When a net is missing from the hoop, the ball may pass so quickly through the hoop that disputes could arise as to whether or not the score was actually made.

Because of the aforementioned difficulties with basketball nets, a number of temporary basketball net supporting devices have been developed and are known. For example, recent U.S. Pat. No. 4,905,995 issued Mar. 6, 1990 to Samuel Apo describes a basketball net assembly comprising a circular collar with a flanged upper end adapted to rest on the top inner half of a permanent basketball rim or hoop. A plurality of holes are equally spaced along the bottom end of the circular collar. A basketball net is attached to the collar. This device can be installed in the hoop by means of a long pole.

Very recent U.S. Pat. No. 5,098,091 dated Mar. 24, 1992 issued to Sean McGivern describes a quick connect/disconnect basketball net support that is able to support a net relative to a rim. This support comprises a flexible, elongate rod that can be formed into a hoop corresponding to the basketball rim. This rod is threaded through upper loops of the netting and its opposite ends can be connected to one another to provide the hoop. Attached to this member are a series of circumferentially spaced connecting means in the form of releasable fasteners. Although this device appears to be relatively simple and easy to make, it does suffer from the aforementioned problem of requiring a ladder or similar form of support to enable a user to instal it on a basketball rim located ten feet above the ground.

U.S. Pat. No. 4,903,964 issued Feb. 27, 1990 to G. E. Anderson describes a basketball net attaching device which includes an annular rim-engaging portion that is of inverted channel-shaped configuration and that can be detachably secured to the rim or hoop. This device is preferably mounted with the aid of a lifting tool which has a hook-shaped end and can advance the device upwardly through the centre of the rim and then draw the rim-engaging portion downwardly into engagement with the rim.

It is an object of the present invention to provide a novel basketball net device for mounting on a basketball hoop, which device can be easily removed from an elevated basketball hoop without the use of a pole or ladder.

It is a further object of the present invention to provide a basketball net device which includes an annular member with a hoop engaging portion, a generally tubular netting attached to this annular member and a closure mechanism for temporarily closing off the passageway through the netting.

It is another object of the invention to provide a basketball net device for temporary mounting on a basketball hoop, which device is inexpensive to manufacture and easy to use.

SUMMARY OF THE INVENTION

According to one aspect of the invention, a basketball net device for mounting on a basketball hoop comprises a generally tubular netting having upper net cords, this netting sized to receive a basketball and to permit passage of the basketball therethrough, and a flexible annular member made of plastics material. This member includes a hoop engaging portion which is generally channel shaped in cross-section for a substantial portion of the circumference of the annular member. There are also means for connecting the upper net cords to this annular member. A circumferential section of the annular member has an outer portion of the hoop engaging portion cut-away, leaving only a narrow inner portion thereof that engages the inner half of an upper surface of the hoop. With this construction the device can be readily removed from the hoop by pulling down on the device and thereby pulling it through the opening formed by the hoop.

The annular member includes a downwardly extending, annular skirt portion that, in use of the device, is positioned inside of the basketball hoop. The upper net cords are connected to this skirt portion. Except for the aforementioned circumferential section thereof, the annular member includes an outwardly extending flange connected to the hoop engaging portion. This flange extends along the circumference. A closure mechanism attached to the lower net cords can be used to temporarily close off the passageway so as to permit a basketball from passing completely through the passageway.

The closure mechanism comprises mating pieces of hook and loop fabric tape material attached to the netting. According to still another aspect of the invention, there is provided a basketball net device capable of being mounted temporarily on a basketball hoop mounted a substantial distance above a playing surface. This device comprises a generally tubular netting having upper net cords, the netting sized to receive a basketball, and a flexible ring-shaped support member including an inner skirt portion having an upper end and a lower end and an outer hoop engaging portion integrally connected to the upper end of the skirt portion. The skirt portion extends downwardly and radially inwardly from its upper end. There are also means for connecting the upper net cords to the lower end of the skirt portion. The hoop engaging portion is of reduced width along a substantial portion of the circumference of the support member so that the support member is able to partially collapse to permit removal of same from the hoop by pulling down on the device and thereby pulling the support member through the hoop.

Further features and advantages will become apparent from the following detailed description taken in conjunction with the accompanying drawings.

Figure 1:
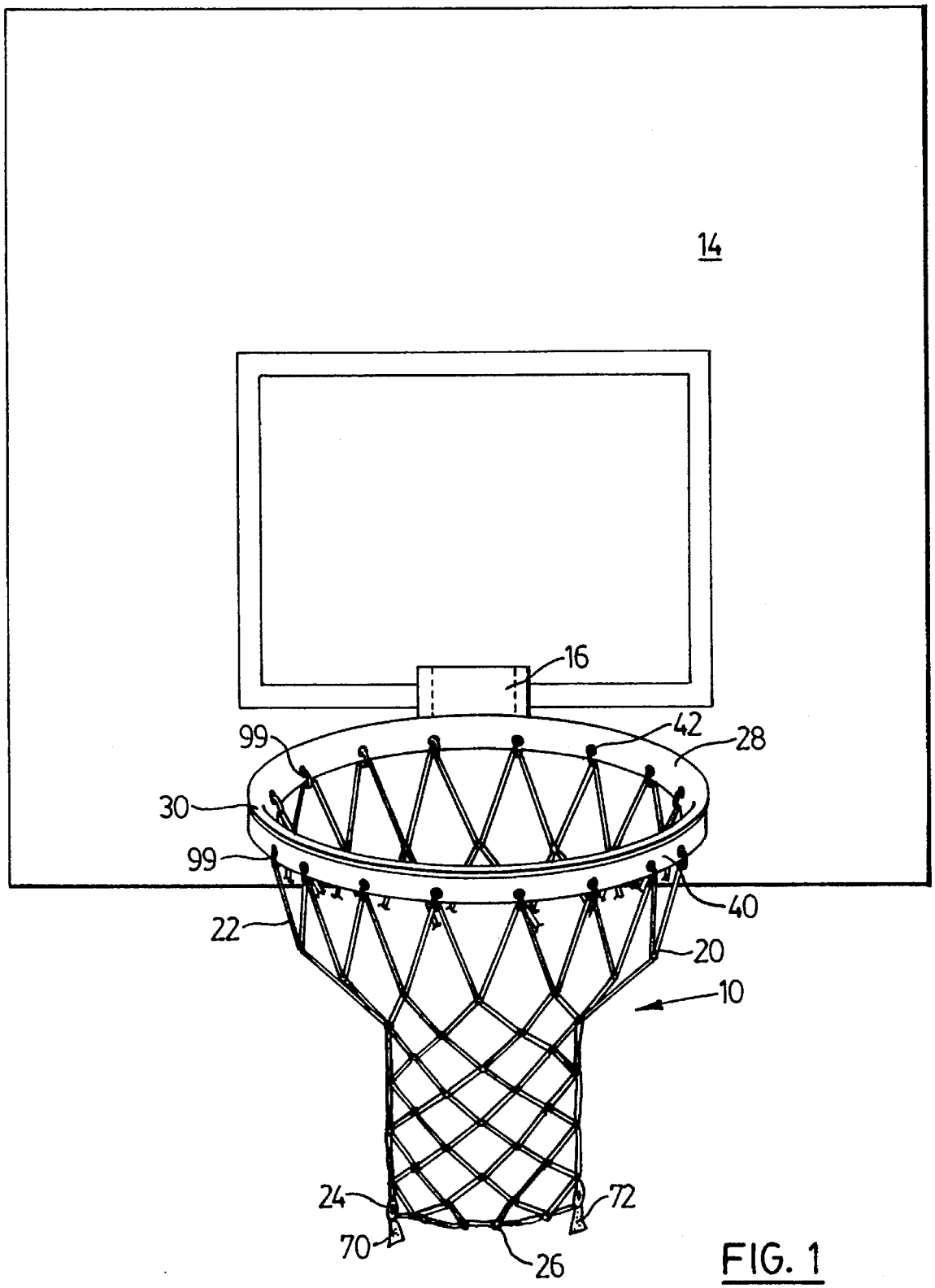
FIG. 1 is a perspective view taken from the front of a basketball hoop and backboard equipped with a basketball net device constructed in accordance with the invention.
Figure 2:
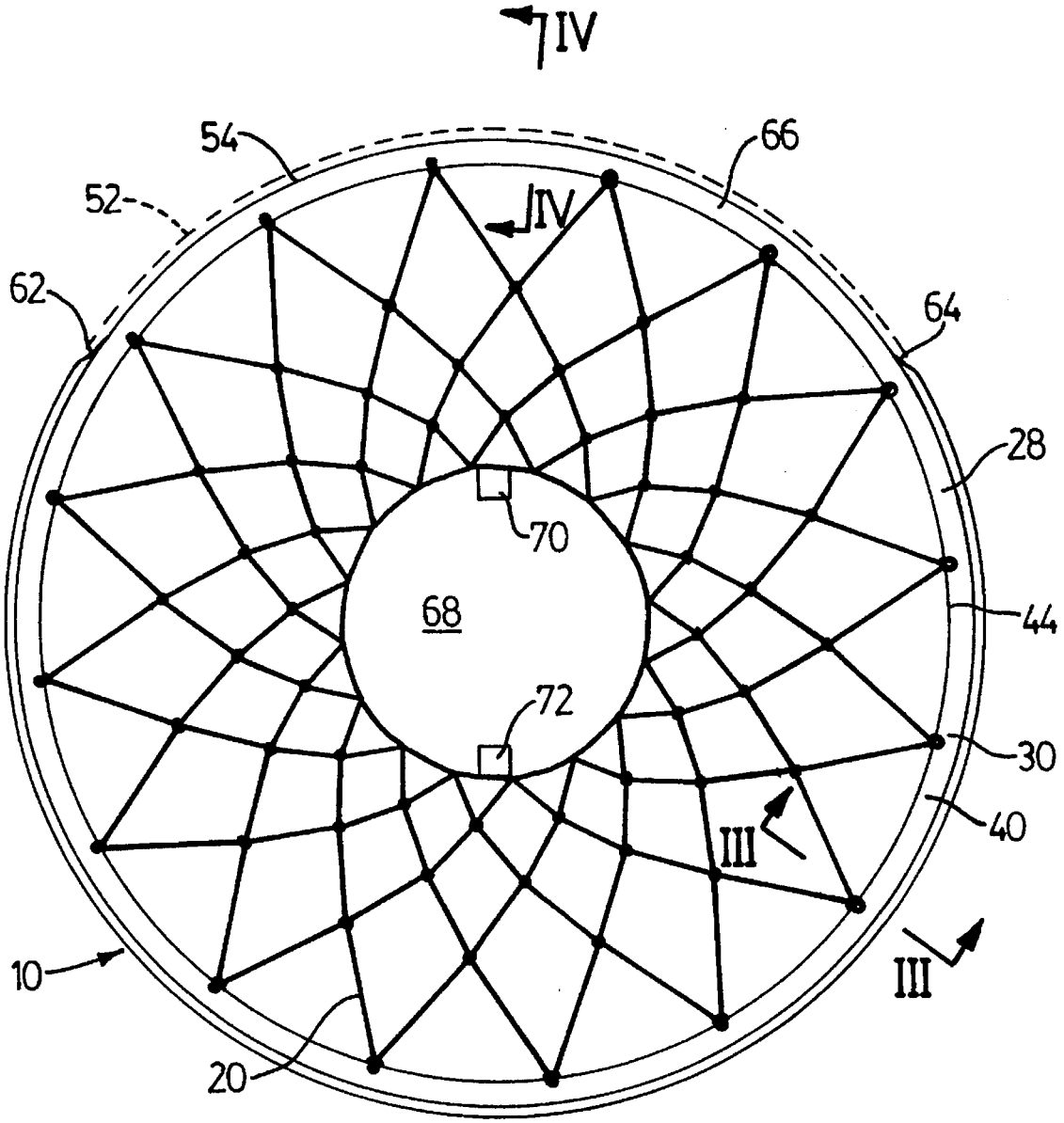
FIG. 2 is a top view of the basketball net device.

A basketball net device 10 constructed in accordance with the invention is illustrated in FIGS. 1 and 2. This device can be mounted temporarily on a permanently installed basketball hoop, the structure of which can be seen from the illustration of FIGS. 5 and 6. This hoop 12 takes the form of a metal ring which can be mounted as much as ten feet above the playing surface or court. The hoop is generally mounted in front of the a suitable backboard 14 which may be made of wood or plexiglass. A support bracket 16 connects the back end of the hoop to the backboard. Often there is a brace member 18 that extends down from each side of the hoop to either the bottom of the bracket 16 or to a suitable location on the backboard. The inside diameter of the hoop 12 is normally eighteen inches, or about 45.7 cm.

The net device of the invention includes a generally tubular netting 20 having upper net cords 22 and lower net cords at 24 spaced from the upper net cords. It will be understood that except for the manner in which the netting is mounted and the attaching mechanism at the bottom of the netting described hereinafter, the netting 20 can be of standard construction similar to or the same as netting used in the past for basketball nets. The netting is sized to receive a standard basketball and to permit passage of the basketball therethrough. It is normally open at both its top end and its bottom end 26. It will be understood that in many basketball courts the netting is directly connected to the aforementioned basketball hoop 12 by suitable means but the netting can become damaged and torn away from the hoop so that the hoop is left with no netting, a generally undesirable state of affairs for a proper game of basketball.

In addition to the netting 20, the net device of the invention includes a flexible, annular member 28 which can be made of a suitable flexible plastics material. A suitable plastic is known as ABS. This member includes a hoop engaging portion 30. The plastic material can be as thin as 1/16th of an inch.

Figure 3:
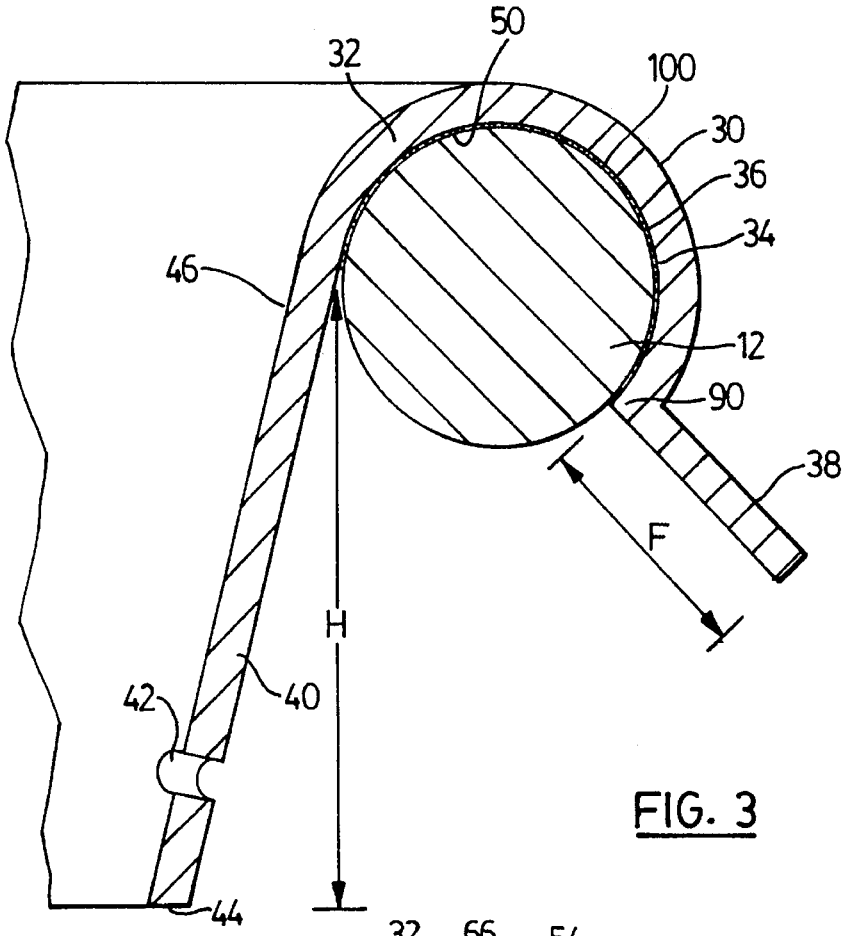
FIG. 3 is a cross-sectional view of the annular supporting member used in the net device, which view is taken along the line III—III of FIG. 2.

For a substantial portion of the circumference of the annular member, this hoop engaging portion 30 is generally channel-shaped in cross-section as illustrated in FIG. 3. The hoop engaging portion includes a radially inward section 32 that extends the entire circumference of the annular member and a radially outward section 34 that extends more than half way around, but not entirely around, the circumference of the annular member. In use of the device, this radially outward section 34 extends along a radially outer half 36 of the top half of the hoop 12. The channel formed by the hoop engaging portion has a substantially open bottom and a semi-circular cross-section in the preferred embodiment. Along more than one half the circumference of the annular member, this member has an outwardly extending flange 38 which is connected to the outer edge of the hoop engaging portion. This flange 38 is helpful in the installation of the net device onto an elevated basketball hoop. A preferred installation procedure for the neck device is described hereinafter. The flange 38 also helps to stiffen the annular member and helps this member to retain a round shape. In one preferred embodiment, the total width of the flange member indicated by the distance F in FIG. 3 is 2 cm.

The preferred net device also includes a downwardly extending, annular skirt portion 40 that, in use of the device, is positioned inside the basketball hoop. The aforementioned upper net cords 22 are connected to the skirt portion 40 as shown in FIG. 1. There are means for connecting the upper net cords to the skirt portion 40. The preferred connecting means includes a number of spaced apart holes 42 distributed evenly about the circumference of the skirt portion near its bottom edge 44. The net cords are connected to the holes in the skirt portion by means of small plastic loops 99 that extend through the holes 42. These loops can be made with known plastic connecting strips that have a series of ridges or grooves along most of their length and a securing mechanism at one end of the strip into which the opposite end of the strip can be inserted and secured. Other forms of connecting means could obviously be used as well, if desired. For example, a number of hook members could be formed along the bottom edge of the skirt portion and the upper net cords could be passed around these hook members. Also, separate hook members that attach to the holes in the skirt portion could be used. Suitably shaped slots could be cut into the bottom edge at an angle and formed with a suitable opening at the top end of the slot to receive an upper net cord.

Figure 4:
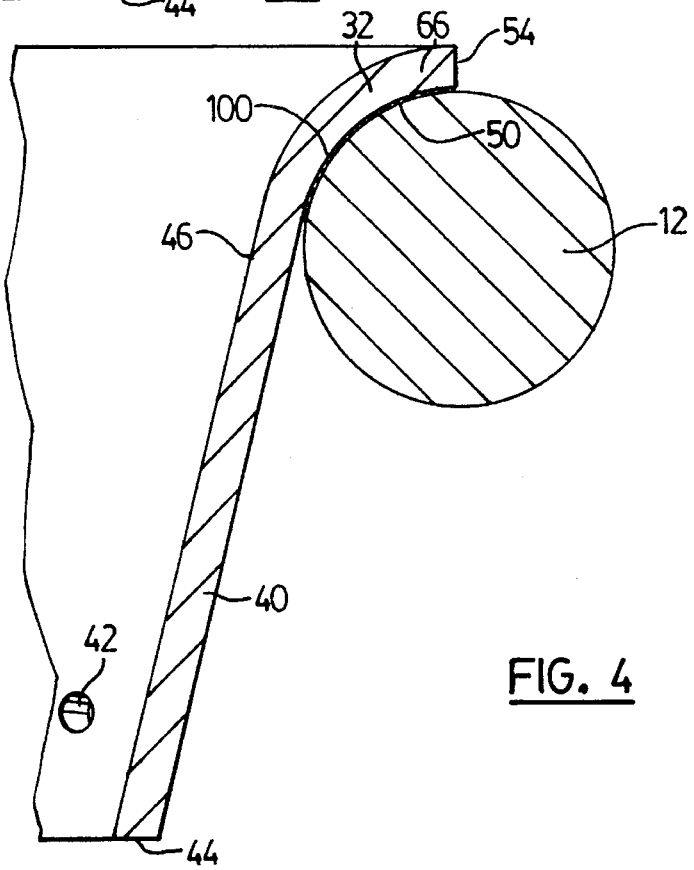
FIG. 4 is another cross-sectional view of the annular supporting member, this view being taken along the line IV—IV of FIG. 2.

The preferred skirt portion 40, as shown in FIGS. 3 and 4, extends both downwardly and radially inwardly from its upper end located at about 46. At its upper end 46, the skirt portion is integrally connected to the inner perimeter of the hoop engaging portion 30. In one preferred embodiment, the height of the skirt portion 40 indicated at H in FIG. 3 is 4.5 cm. Also, in a preferred embodiment, the skirt portion 40 is steeply sloped at an angle to the horizontal plane of about 70 degrees or more and substantially less than 90 degrees. The provision of the skirt portion is desirable not only to increase the rigidity and strength of the annular member but also in assisting the device to locate itself properly on the basketball hoop when the device is being installed thereon. As clearly shown in FIGS. 3 and 4, the skirt portion is able to fit inside the hoop and its inner diameter defined by the bottom end or bottom edge 44 is less than the inside diameter of the basketball hoop 12, which diameter is set at eighteen inches for a regulation basketball game.

Figure 6:
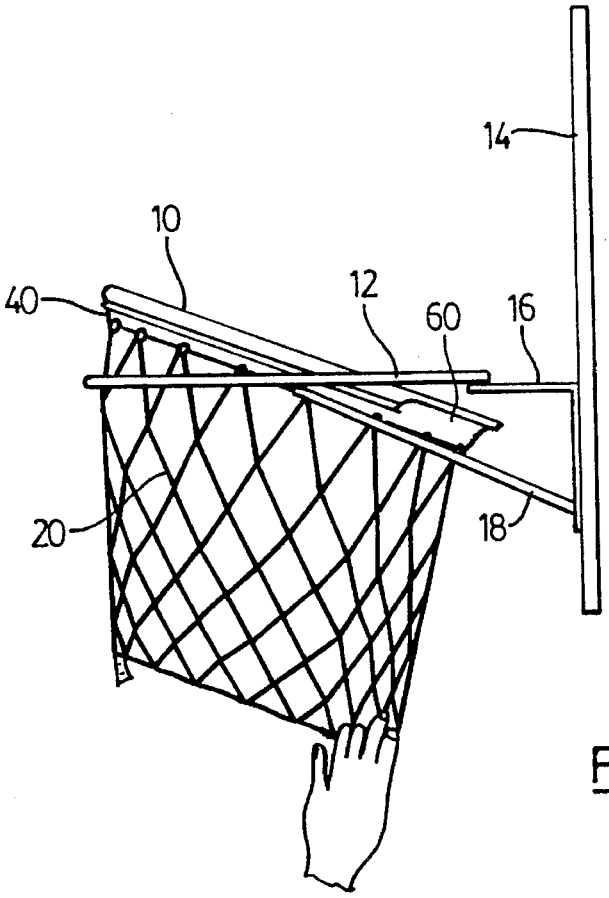
FIG. 6 is a schematic illustration of how the basketball net device of the invention can be removed or dismounted from a basketball hoop.

As illustrated in FIGS. 2 and 4 of the drawings, a circumferential section of the annular member 28 has an outer portion of its hoop engaging portion 30 cut-away, leaving only a narrow inner portion thereof that engages the inner half 50 of an upper surface of the hoop 12. The cut-out or cut-away section extends between the dashed line 52 shown in FIG. 2 and the adjacent upper edge 54 of the reduced hoop engaging portion. As explained further hereinafter, the purpose of this reduced hoop engaging portion is to permit the net device 10 to be readily removed from the hoop 12 by pulling down on the device as illustrated in FIG. 6. By grabbing on to the bottom of the netting 20, as illustrated, one can pull the device through the circular opening formed by the hoop 12. This is due to the fact that the annular member is sufficiently flexible, particularly in the region where hoop engaging portion has been reduced that it will bend and partially collapse to permit the reduced hoop engaging portion indicated at 60 in FIG. 6 to pass by the inside of the hoop. At the same time, the device 10 commences a pivoting action so as to form an angle with the horizontal surface of the hoop as shown in FIG. 6. In order to assist in the removal of the device, the preferred circumferential section which is cut away has tapered end regions 62 and 64 shown in FIG. 2. These regions provide a transition from the reduced hoop engaging portion, the cross-section for which is shown in FIG. 4 to the remainder of the annular member which has a full hoop engaging portion 30. The full hoop engaging portion extends for a substantial portion of the circumference of the annular member and, in the preferred illustrated embodiment, it extends through an angle of about 270° in the horizontal plane. This leaves the circumferential section 66 which has an outer portion of its hoop engaging portion cut-away extending an angle of about 90°.

Preferably, the net device of the invention is equipped with closure means attached to the netting for temporarily closing off an opening 68 at the bottom end of the netting, that is the end furthest from the annular member 28, so as to prevent a basketball from passing completely through the netting. One preferred form of closure means comprises mating sections 70 and 72 of hook and loop fabric tape material, these mating sections being attached to opposite sides of the netting as illustrated in FIG. 2. A common form of hook and loop fabric tape material that can be used for this purpose is that sold under the trademark Velcro.

Figure 5:
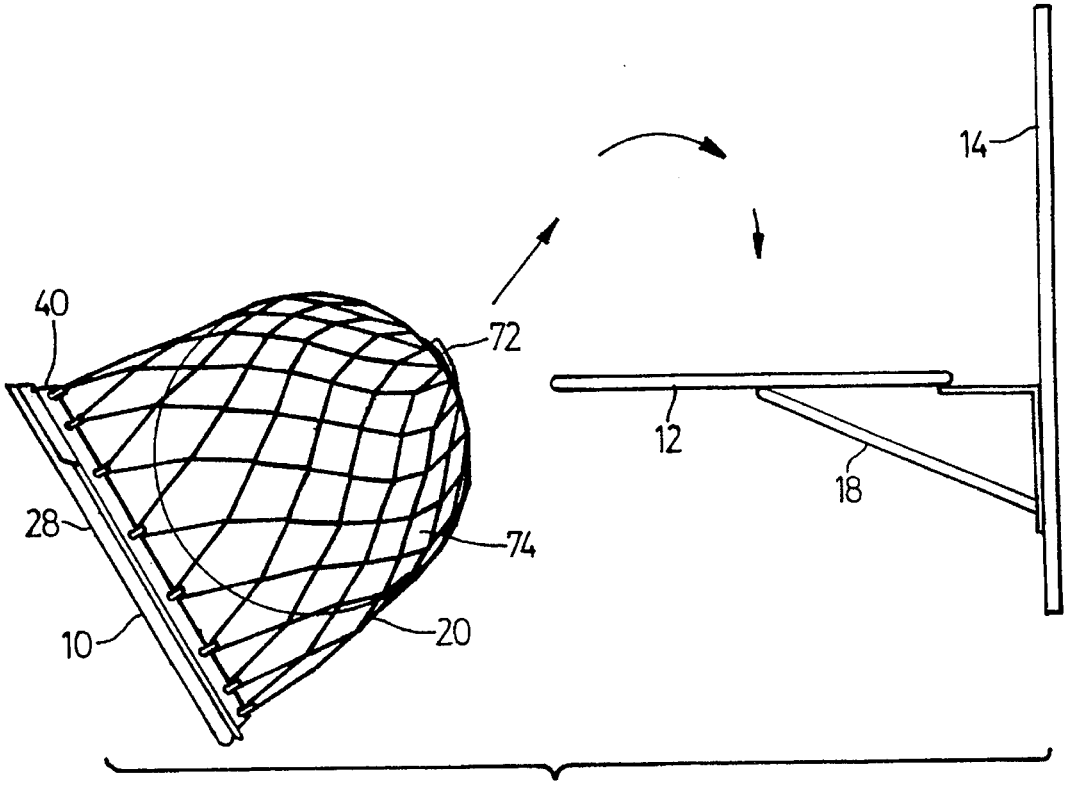
FIG. 5 is a schematic illustration showing the manner in which the basketball net device can be mounted on an elevated basketball hoop using a basketball.

The manner in which this closure mechanism can be used to mount the net device 10 on an elevated hoop 12 is illustrated in FIG. 5. The two tape sections 70 and 72 are engaged with one another so as to close the bottom end of the netting and a standard basketball 74 is inserted through the annular member and placed fully into the netting 20. It is then possible for a user of the device to throw both the device 10 and the basketball 74 up and over the hoop 12. Assuming that the user has thrown this combination with reasonable accuracy, the basketball 74 due to its weight will tend to pass first through the hoop 12 and the annular member 28 will follow behind it. However, because the outer circumference of the annular member is substantially greater than the interior diameter of the hoop, the annular member will engage the top of the hoop. Then the weight and momentum of the basketball and the fact that the basketball will tend to centre itself relative to the hoop as it passes therethrough, will cause the hoop engaging portion 30 (as shown in FIG. 3) to be pulled around and into full engagement with the hoop. The reduced portion 66 of the annular member will tend to engage the adjacent section of the hoop in the manner shown in FIG. 4. Furthermore, the downward force and momentum of the basketball once the annular member has become engaged with the hoop, will generally force the two tape sections 70 and 72 to become separated and disengage, thus leaving the netting open at the bottom for the ball to fall through so that it can be readily retrieved by the user. Even if the momentum of the basketball is not sufficient to disengage the tape sections, it is generally a simple process for the user of the device to reach up or jump up and manually disengage the two mating sections, thus permitting the ball to drop out.

It will be appreciated that the flange 38 that extends a substantial distance around the circumference of the annular member helps in the installation process in that the flange will tend to slip over the rounded top of the hoop and down the outside of the hoop 12. The engagement of the hoop with the bottom of the flange 38 will tend to pry open or open up the rounded channel formed by the hoop engaging portion 30. For this reason, preferably the flange extends both outwardly and downwardly from the outer edge 90 of the hoop engaging portion. The preferred illustrated flange extends at an angle to the horizontal that is greater than 30° but which is less than 60° and it is typically about 45° to the horizontal.

An optional feature of the net device 10 of the invention is the application of a thin layer 100 of tacky adhesive material on the inner surface of the hoop engaging portion 30. The use of this adhesive, which can be sprayed on, helps keep the device 10 in place on the hoop 12 and can eliminate annoying chattering sound between the device 10 and the hoop.

Various modifications and changes could be made to the described net device without departing from the spirit and scope of this invention and such modifications and changes will be apparent to one skilled in the manufacture and construction of basketball hoops and related devices. Accordingly, all such modifications and changes as fall within the scope of the appended claims are intended to be part of this invention.

I therefore claim:

1. A basketball net device for mounting on a basketball hoop, comprising:

a generally tubular netting having upper net cords, said netting sized to receive a basketball and to permit passage of the basketball therethrough; and a flexible, annular member made of plastics material, said member including a hoop engaging portion which is generally channel-shaped in cross-section for a substantial portion of the circumference of said annular member, a downwardly extending, annular skirt portion that, in use of the device, is positioned inside of said basketball hoop, and means for connecting said upper net cords to said skirt portion, wherein a circumferential section of said annular member has an outer portion of said hoop engaging portion cut-away, leaving only a narrow inner portion thereof that engages the inner half of an upper surface of said hoop, whereby said device can be readily removed from said hoop by pulling down on said device and thereby pulling it through the opening formed by said hoop; and wherein, except for said circumferential section thereof, said annular member includes an outwardly extending flange connected to said hoop engaging portion, said flange extending along said annular member for more than one half its circumference.

2. A basketball net device according to claim 1 wherein said connecting means comprises a number of holes distributed along a bottom edge of said skirt portion.

3. A basketball net device according to claim 1 said flange extends both outwardly and downwardly from an outer edge of said hoop engaging portion.

4. A basketball net device according to claim 1 including closure means attached to said netting for temporarily closing off an opening at the end of said netting furthest from said annular member so as to prevent a basketball from passing completely through said netting.

5. A basketball net device according to claim 4 wherein said closure means comprise mating sections of hook and loop fabric tape material, said mating sections being attached to opposite sides of said netting.

6. A basketball net device for mounting on a basketball hoop, comprising:

a generally tubular netting having upper net cords, said netting sized to receive a basketball and to permit passage of the basketball therethrough; and a flexible, annular member made of plastics material, said member including a hoop engaging portion which is generally channel-shaped in cross-section for a substantial portion of the circumference of said annular member, a downwardly extending, annular skirt portion that, in use of the device, is positioned inside of said basketball hoop, and means for connecting said upper net cords to said skirt portion, wherein a circumferential section of said annular member has an outer portion of said hoop engaging portion cut-away, leaving only a narrow inner portion thereof that engages the inner half of an upper surface of said hoop and said circumferential section which is cut-away has tapered end regions providing a transition from said circumferential section to the remainder of said annular member which has a full hoop engaging portion, whereby said device can be readily removed from said hoop by pulling down on said device and thereby pulling it through the opening formed by said hoop, said tapered end regions assisting in the removal of said device when it is pulled through the opening.

7. A basketball net device for mounting on a basketball hoop comprising:

a generally tubular netting having upper net cords, said netting sized to receive a basketball and to permit passage of the basketball therethrough; and a flexible, annular member made of plastics material, said member including a hoop engaging portion which is generally channel-shaped in cross-section for a substantial portion of the circumference of said annular member and means for connecting said upper net chords to said annular member, wherein a circumferential section of said annular member has an outer portion of said hoop engaging portion cut-away, leaving only a narrow inner portion thereof that engages the inner half of an upper surface of said hoop and said circumferential section extends through an arc subtending an angle of about 90 degrees, whereby said device can be readily removed from said hoop by pulling down on said device and thereby pulling it through the opening formed by said hoop.

8. A basketball net device for mounting on a basketball hoop comprising:

a generally tubular netting having upper net cords, said netting sized to receive a basketball and to permit passage of the basketball therethrough; and a flexible, annular member made of plastics material, said member including a hoop engaging portion which is generally channel-shaped in cross-section for a substantial portion of the circumference of said annular member, said hoop engaging portion has an inner surface thereof covered with a tacky adhesive material in order to keep said net device in place on said hoop, said inner surface facing towards said hoop during use of the net device; and means for connecting said upper net cords to said annular member, wherein a circumferential section of said annular member has an outer portion of said hoop engaging portion cut-away, leaving only a narrow inner portion thereof that engages the inner half of an upper surface of said hoop, whereby said device can be readily removed from said hoop by pulling down on said device and thereby pulling it through the opening formed by said hoop.

9. A basketball net device capable of being mounted temporarily on a basketball hoop mounted a substantial distance above a playing surface, said device comprising:

a generally tubular netting having upper net cords, said netting sized to receive a basketball, a flexible ring-shaped support member including an inner skirt portion having an upper end and a lower end and an outer hoop engaging portion integrally connected to the upper end of the skirt portion, said skirt portion extending downwardly and radially inwardly from its upper end; and means for connecting said upper net cords to said lower end of said skirt portion, wherein said hoop engaging portion is of reduced width along a substantial portion of the circumference of said support member so that said support member is able to partially collapse to permit removal of same from the hoop by pulling down on said device and thereby pulling the support member through the hoop, said hoop engaging portion having an inner surface thereof covered with a tacky adhesive material in order to keep said net device in place on said hoop during use of said net device, said inner surface facing toward said hoop during use of the net device.

10. A basketball net device according to claim 9 wherein along more than one half the circumference of said support member said hoop engaging portion forms a channel with a substantially open bottom and a semi-circular cross-section.

11. A basketball net device according to claim 10 wherein along more than one half the circumference of said annular member, said support member has an outwardly extending flange connected to said hoop engaging portion.

12. A basketball net device according to claim 10 including hook and loop tape closure means attached to said netting for temporarily closing off an opening at the end of said netting furthest from said support member so as to prevent a basketball from passing completely through said netting.

* * * * *